US007717072B2

(12) United States Patent
Schafer et al.

(10) Patent No.: US 7,717,072 B2
(45) **Date of Patent: *May 18, 2010**

(54) ADJUSTMENT DEVICE FOR ADJUSTING THE RELATIVE ROTATIONAL ANGLE POSITION OF A CAMSHAFT IN RELATION TO A CRANKSHAFT OF AN INTERNAL COMBUSTION ENGINE

(75) Inventors: Jens Schafer, Herzogenaurach (DE); Martin Steigerwald, Erlangen (DE); Jonathan Heywood, Pettstadt (DE)

(73) Assignee: Schaeffler KG, Herzogenaurach (DE)

( * ) Notice: Subject to any disclaimer, the term of this patent is extended or adjusted under 35 U.S.C. 154(b) by 41 days.

This patent is subject to a terminal disclaimer.

(21) Appl. No.: 12/136,832

(22) Filed: Jun. 11, 2008

(65) Prior Publication Data

US 2008/0236530 A1 Oct. 2, 2008

Related U.S. Application Data

(62) Division of application No. 10/578,599, filed as application No. PCT/EP2004/011151 on Oct. 6, 2004, now abandoned.

(30) Foreign Application Priority Data

Nov. 8, 2003 (DE) ..... 103 52 255

(51) Int. Cl.
*F01L 1/34* (2006.01)

(52) U.S. Cl. ..... 123/90.15; 123/90.17; 123/90.31; 464/160

(58) Field of Classification Search ..... 123/90.15, 123/90.16, 90.17, 90.18, 90.27, 90.31; 464/1, 464/2, 160; 475/4, 149, 150, 230
See application file for complete search history.

(56) References Cited

U.S. PATENT DOCUMENTS

| | | | | |
|---|---|---|---|---|
| 5,365,898 | A | 11/1994 | Mueller | |
| 5,536,215 | A | 7/1996 | Shaffer et al. | |
| 6,129,061 | A * | 10/2000 | Okuda et al. | 123/90.17 |
| 6,419,607 | B1 | 7/2002 | Wild et al. | |
| 6,457,446 | B1 | 10/2002 | Willmot | |
| 6,460,500 | B1 | 10/2002 | Ooyama et al. | |

(Continued)

FOREIGN PATENT DOCUMENTS

| | | |
|---|---|---|
| DE | 35 36 919 | 4/1987 |

(Continued)

*Primary Examiner*—Ching Chang
(74) *Attorney, Agent, or Firm*—Volpe and Koenig, P.C.

(57) ABSTRACT

An adjustment device (1) for adjusting the relative rotational angle position of a camshaft (2) in relation to a crankshaft of an internal combustion engine is provided, with the device having an adjustment mechanism (3), which is embodied as a triple-shaft transmission and provided with an input part (4) fixed to the crankshaft, an output part fixed to the camshaft, and an adjusting shaft (7) connected to an adjusting motor shaft (5) of an adjusting motor (6). The motor (6) is provided as an electric motor and is arranged parallel to the camshaft (2). The motor generates an adjustment torque that is transmitted to the adjustment shaft (7) via a secondary drive (18) that has a belt drive, a chain drive, a cardan drive, or an additional spur gear stage.

2 Claims, 3 Drawing Sheets

U.S. PATENT DOCUMENTS

| | | | | |
|---|---|---|---|---|
| 7,506,623 | B2 * | 3/2009 | Schafer et al. | 123/90.17 |
| 2001/0008129 | A1 | 7/2001 | Yamada | |

FOREIGN PATENT DOCUMENTS

| | | | |
|---|---|---|---|
| DE | 197 02 670 | | 3/1998 |
| DE | 10220687 | A1 * | 11/2003 |
| GB | 518581 | | 3/1940 |
| JP | 2001333675 | | 5/2000 |

* cited by examiner

ADJUSTMENT DEVICE FOR ADJUSTING THE RELATIVE ROTATIONAL ANGLE POSITION OF A CAMSHAFT IN RELATION TO A CRANKSHAFT OF AN INTERNAL COMBUSTION ENGINE

CROSS-REFERENCE TO RELATED APPLICATIONS

This application is a divisional of U.S. patent application Ser. No. 10/578,599, filed May 8, 2006, which is the U.S. National Phase of PCT/EP04/11151, filed Oct. 6, 2004, which claimed the benefit of DE 103 52 255.7, filed Nov. 8, 2003, all of which are incorporated by reference as if fully set forth.

BACKGROUND

The invention relates to an adjustment device for adjusting the relative rotational angle position of a camshaft in relation to a crankshaft of an internal combustion engine, with the device comprising an adjustment mechanism, which is embodied as a triple-shaft transmission and provided with an input part fixed to the crankshaft, an output part fixed to the camshaft, and an adjusting shaft connected to an adjusting motor shaft of an adjusting motor.

In modern internal combustion engines, a camshaft adjuster is used for varying the timing of gas-exchange valves, whereby an improvement in consumption and output is achieved over the entire load and rpm range. It is known that camshaft adjusters can be actuated hydraulically. Conventional, hydraulically actuated camshaft adjusters (axial piston adjusters, vane cells, pivoting vanes and segmented vanes) have the advantage that the hydraulic valve required for control does not have to be arranged directly axially in front of the adjuster, but instead can be mounted off-center at a position, where sufficient installation space is available for the valve. The oil is led via bore holes in the cylinder head to the adjuster. Therefore, hydraulic camshaft adjusters are built very short and can also be installed under tight installation conditions. Because the adjustment is realized by the pressure of motor oil in conventional, hydraulic camshaft adjusters, the function of the camshaft adjuster is very dependent on the temperature of the motor oil. At low temperatures and thus thick oil, the camshaft adjuster responds not at all or only sluggishly due to the low volume flow. At high temperatures and thus very thin oil, a high pressure is not established, which is why a slow adjustment is also realized under this condition. In addition, the oil pressure and thus the function of the camshaft adjuster depends on the rpm of the internal combustion engine.

These disadvantages do not appear in an electric camshaft adjuster built from an electric motor and adjustment mechanism. However, as provided, for example, from the publication DE 4110195 A1, conventionally this adjuster is embodied such that the electric motor is arranged axially in front of the adjustment mechanism and thus requires a large amount of axial installation space.

SUMMARY

Therefore, the invention is based on the objective of creating an adjustment device for adjusting the rotational angle position of a camshaft in relation to a crankshaft of an internal combustion engine, with the device combining the advantages of the electric camshaft adjuster with the advantage of a very short construction space similar to the hydraulic devices.

According to the invention, for an internal combustion engine, the objective is met in that the adjusting motor is provided as an electric motor. It is either placed spatially separated from the adjustment mechanism, wherein the adjusting torque generated by it either is transmitted mechanically by a flexible shaft to the adjustment mechanism or drives a compressor, whose compressed air acts on the adjustment mechanism via a pneumatic motor, or drives a pump for hydraulic fluid, which acts on the adjustment mechanism via a hydraulic motor. Alternatively, it is arranged radial or parallel in relation to the camshaft, and the adjusting torque generated by the electric motor is transmitted via a toothed gear or a secondary drive to the adjusting shaft.

In the first case, the electric motor can be placed arbitrarily. The adjusting torque generated by it is transmitted by the flexible shaft. The flexible shaft can be variably adapted—like a speedometer shaft—to the installation space and here transmits the rotation and the torque from the electric motor shaft to the adjusting shaft of the adjustment mechanism. Because the efficiency of this transmission is very high, the spatial separation of adjustment mechanism and electric motor can be realized. In order not to load the power balance of the internal combustion engine surroundings too much, it has proven especially advantageous to use a low-output, but quickly rotating electric motor. Its torque is then transmitted via the flexible shaft to the adjusting shaft of the adjustment mechanism, whose transmission ratio preferably lies in the range of 1:50 to 1:120.

In the second case, the adjustment mechanism is not connected directly to an electric motor, but instead to a pneumatic motor. The essential advantage of the pneumatic motor is that the motor can be built with a significantly shorter axial size than an electric motor used directly for adjusting or can be partially integrated into the installation space of the transmission. The rotational direction of the pneumatic motor is controlled by a directional control valve, which draws the needed compressed air from a compressor that is driven, on its side, by an electric motor. It is advantageous to use a directional control valve, which is in the closed position when not actuated. Both the compressor and also the electric motor are arranged off-center relative to the adjustment mechanism at a position where there is sufficient installation space. For preventing pressure fluctuations during operation, a pressurize reservoir, which equalizes possible pressure fluctuations, is arranged between the compressor and directional control valve. This pressure reservoir can then also be placed arbitrarily. Another advantage of the pressurize reservoir is that even when the internal combustion engine is started, there is sufficient pressure for operating the pneumatic motor, even if sufficient pressure had not yet been generated by the compressor. In particular, the cold-start behavior of the internal combustion engine is improved. So that the compressed air does not bleed out of the pressurize reservoir when the electric motor is idling, there is a non-return valve between the reservoir and the compressor.

The compressor can also be driven by a belt of the internal combustion engine instead of by an electric motor. However, then the compressor rpm is dependent on the rpm of the internal combustion engine, while for the use of an electric motor, the compressor can always be operated independent of the internal combustion engine. As an alternative, when driven with a belt, a motor with variable volume displacement, e.g., a double-stroke vane-cell motor, can also be used.

In the third case, the adjustment is realized by a hydraulic motor. The construction and operation of the system correspond to that of the electric, pneumatic system, except that as the medium, a fluid is used instead of air. The directional control valve can be represented by a proportional valve, two 3/2 directional valves, four 2/2 directional valve, or by a controllable pump and a 4/2 directional valve in switch or proportional configuration. The advantage in this system lies in that higher pressures can be generated. A disadvantage is the somewhat higher expense in terms of the recirculation of the fluid. As fluid, the oil of the motor oil cycle, but also a different, additional fluid can be used, which is not exposed to such strong operating temperature fluctuations. Due to the pressurized hydraulic accumulator, the pressure is already ready at the start phase of the internal combustion engine. Thus, the hydraulic motor can be operated more reliably than a hydraulic device for rotational angle adjustment.

If installation space is available radial to the adjustment shaft, it is also possible to embody the adjustment motor as an electric motor and to arrange it radially. Its adjusting torque is driven via a toothed gear, whose transmission ratio is preferably 1:1. Here, for example, bevel gear pairs, worm gear pairs, or spiral gear pairs are conceivable as configurations of the mechanism. The advantage of these systems is that compressed air units are neither necessary nor do they have to be integrated into a fluid cycle. The system is thus simpler in construction, not-sensitive to breaks in seals, and is thus more maintenance-friendly.

As a fifth solution, it is provided to arrange the adjustment motor parallel to the adjustment mechanism. The torque transmission from the adjustment motor shaft to the adjustment mechanism is then realized by means of a secondary drive. This secondary drive can be formed, for example, as a belt drive, a chain drive, a cardan drive, or as an additional spur gear stage. The advantages of this arrangement are the same as in the radial electric motor: compressed air units are neither necessary nor have to be integrated into a fluid cycle. The system is thus simpler in construction, not sensitive to breaks in seals, and is thus more maintenance-friendly.

BRIEF DESCRIPTION OF THE DRAWINGS

The invention is explained in more detail below and is shown schematically in the associated drawings.

Shown are.

DETAILED DESCRIPTION OF THE PREFERRED EMBODIMENTS

Figure 1:
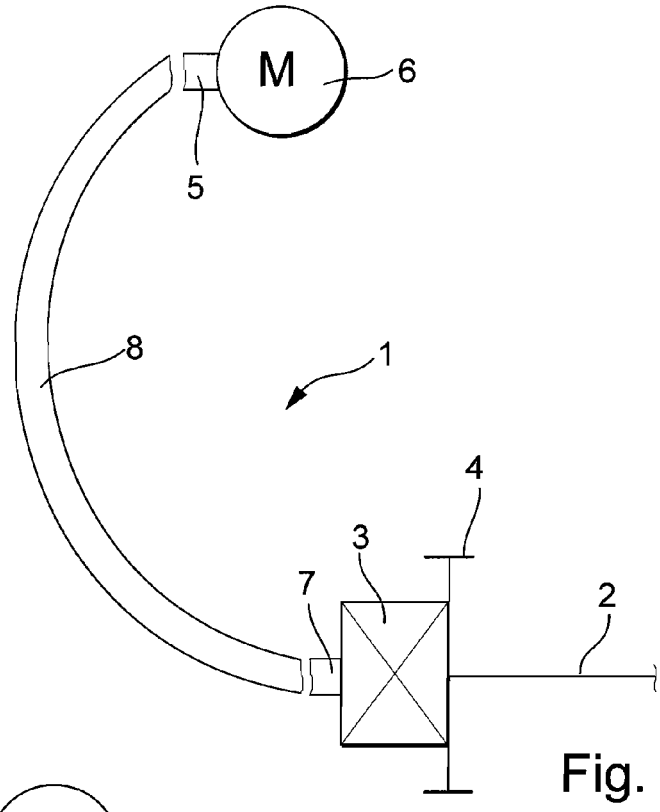
FIG. 1 a schematic representation of an electromechanical system with electric motor, flexible shaft, adjustment mechanism, and camshaft.

From FIG. 1 emerges the principle arrangement of the components of an adjustment device 1 for electromechanical adjustment of the relative rotational angle position of a camshaft 2 relative to a crankshaft (not shown) of an internal combustion engine with an adjustment mechanism 3, which is embodied as a triple-shaft transmission and which has an input part 4 fixed to the crankshaft, an output part fixed to the camshaft, and an adjustment shaft 7 connected to an adjustment motor shaft 5 of an electric motor 6. The adjusting torque of the adjustment motor shaft 5 generated by the electric motor 6 is transmitted mechanically from a flexible shaft 8 to the adjustment shaft 7. Therefore, spatial separation of the electric motor 6 and the adjustment mechanism 3 is possible. The illustrated spatial position of the components of the adjustment device 1 is to be considered only as an example, because the flexible shaft 8 can be adapted to the installation space.

Figure 2:
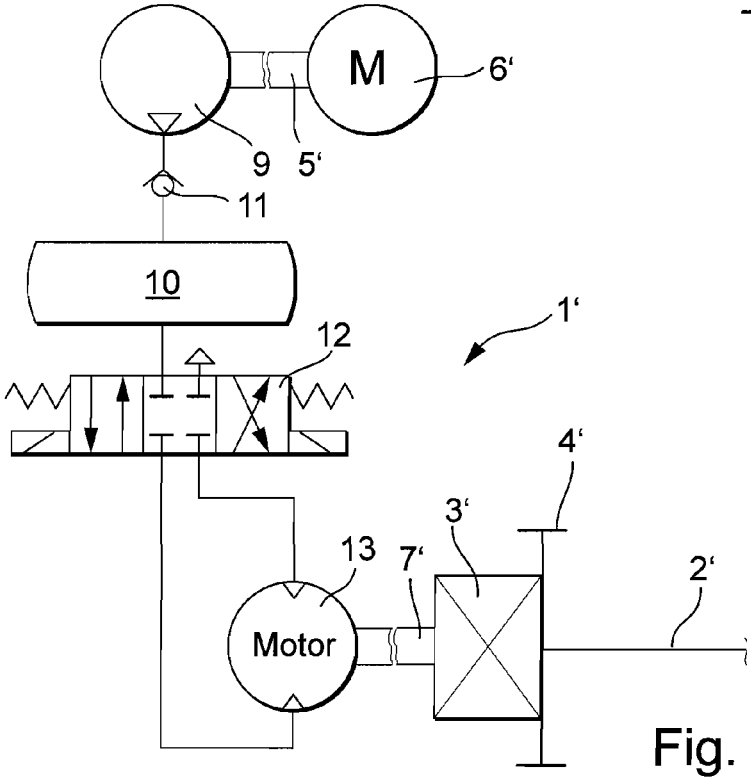
FIG. 2 a schematic representation of an electric, pneumatic system with electric motor, compressor, non-return valve, pressurize reservoir, directional control valve, pneumatic motor, adjustment mechanism, and camshaft.

FIG. 2 shows the principle arrangement of the components of an adjustment device 1' for electromechanical adjustment of the relative rotational angle position of a camshaft 2' relative to a crankshaft (not shown) of an internal combustion engine with an adjustment mechanism 3', which is embodied as a triple-shaft transmission and which has an input part 4' fixed to the crankshaft, an output part fixed to the camshaft, and an adjustment shaft 7' driven by a pneumatic motor 13. The adjustment torque of the adjustment motor shaft 5' generated by an electric motor 6' drives a compressor 9, which provides compressed air to a pressurize reservoir 10. Here, a non-return valve 11 is arranged between the pressurize reservoir 10 and the compressor 9, so that compressed air is already available when the internal combustion engine is initially started and the compressor is not yet running. The pressurize reservoir 10 is connected via compressed air with a directional control valve 12 in a switching or proportional configuration, which is embodied, for example, as a 4/3 directional valve with two magnetic coils. The directional control valve 12 controls a pneumatic motor 13, which is fixed in rotation with the adjustment shaft 7' of the adjustment mechanism 3'.

Figure 3:
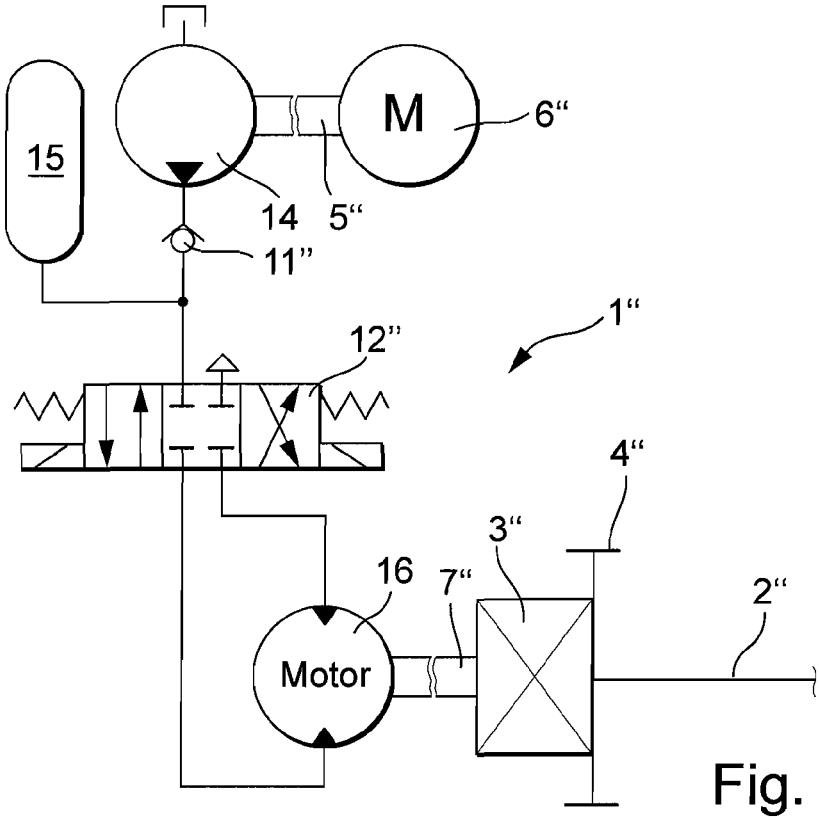
FIG. 3 a schematic representation of an electric, hydraulic system with electric motor, pump, non-return valve, pressurized container, directional control valve, hydraulic motor, adjustment mechanism, and camshaft.

FIG. 3 shows the principle arrangement of the components of an adjustment device 1" for electromechanical adjustment of the relative rotational angle position of a camshaft 2" in relation to a crankshaft (not shown) of an internal combustion engine with an adjustment mechanism 3", which is embodied as a triple-shaft transmission and which has an input part 4" fixed to the crankshaft, an output part fixed to the camshaft, and an adjustment shaft 7" driven by a hydraulic motor 16. The adjustment torque of the adjustment motor shaft 5" generated by an electric motor 6" drives a pump, which pumps fluid into a pressurized hydraulic accumulator 15. Between the hydraulic accumulator 15 and pump 14 there is a non-return valve 11', so that pressurized fluid is already available when the internal combustion engine is started and the pump is not yet running. The hydraulic accumulator 15 is connected to a direction control valve 12", which is embodied, for example, as a proportional valve. The direction control valve 12" controls a hydraulic motor 16, which is locked in rotation with the adjustment shaft 7" of the adjustment mechanism 3".

Figure 4:
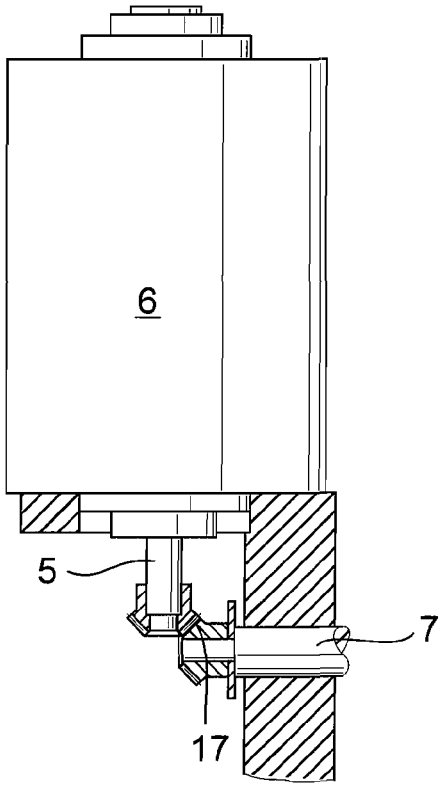
FIG. 4 a cross-sectional representation of an electromechanical system with radial adjustment motor shaft.

FIG. 4 shows a cross section through the essential components of an adjustment device 1 (FIG. 1) for electromechanical adjustment of the relative rotational angle position of a camshaft 2 (FIG. 1) in relation to a crankshaft (not shown) of an internal combustion engine with an adjustment mechanism 3 (FIG. 1), which is embodied as a triple-shaft transmission and which has an input part fixed to the crankshaft, an output part fixed to the camshaft, and an adjustment shaft 7 connected to an adjustment motor shaft 5 of an electric motor 6, wherein the electric motor 6 is arranged radially. The adjustment torque of the adjustment motor shaft 5 generated by the electric motor 6 is transmitted mechanically from a toothed gear 17 to the adjustment shaft 7. Therefore, a radial arrangement of electric motor 6 and adjustment shaft 7 is possible.

Figure 5:
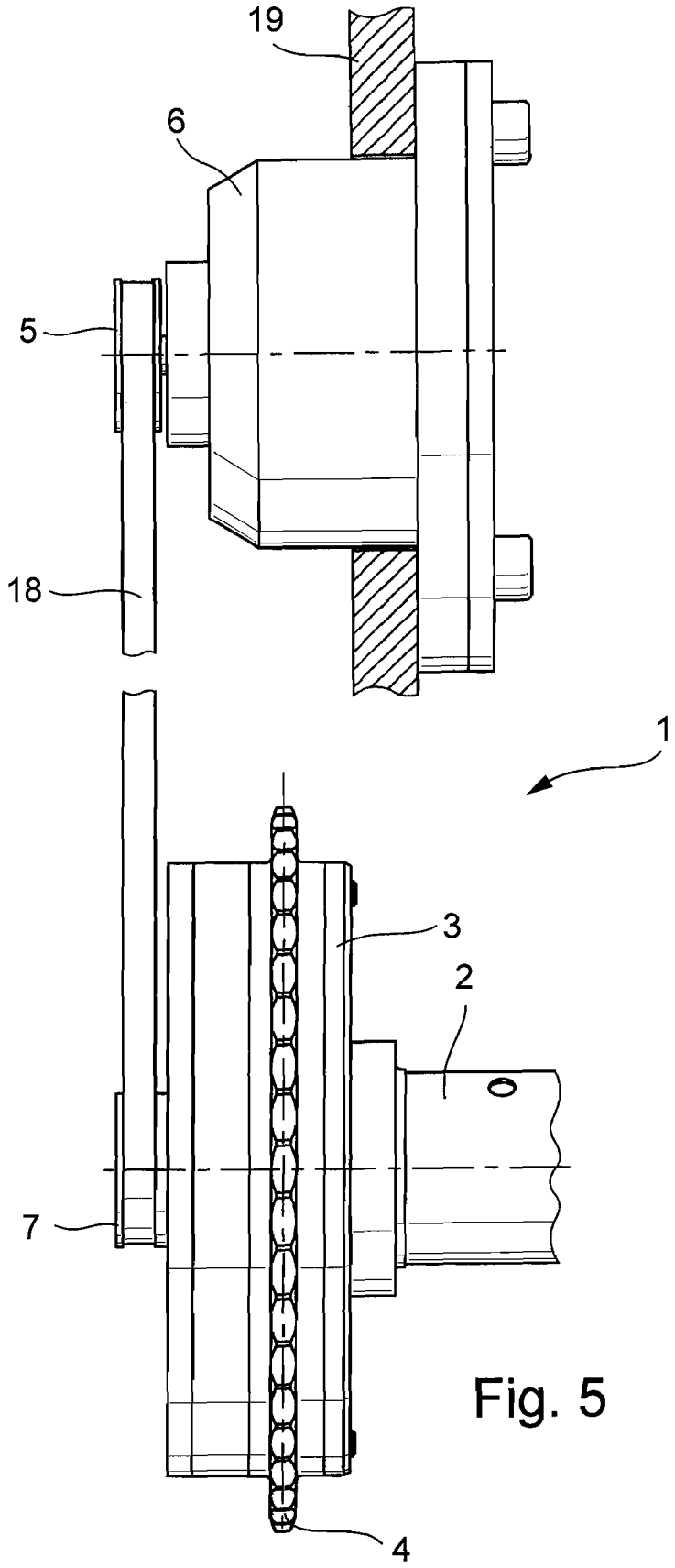
FIG. 5 a cross section of an electromechanical system with parallel adjustment motor.

FIG. 5 shows a cross section through the essential components of an adjustment device 1 (FIG. 1) for electromechanical adjustment of the relative rotational angle position of a camshaft 2 (FIG. 1) in relation to a crankshaft (not shown) of an internal combustion engine with an adjustment mechanism 3 (FIG. 1), which is embodied as a triple-shaft transmission and which has an input part fixed to the crankshaft, a driven part fixed to the camshaft, and an adjustment shaft 7 connected to an adjustment motor shaft 5 of an electric motor 6, wherein the electric motor is arranged parallel to the adjustment shaft. The adjustment torque of the adjustment motor shaft 5 generated by the electric motor 6 is transmitted mechanically from a secondary drive 18 to the adjustment shaft 7. In FIG. 5, the secondary drive is illustrated as a belt drive.

All of the disclosed solutions have the advantage that the electric motor no longer has to be arranged in front of the adjustment shaft, whereby a considerable shortening of the installation space is possible. It can be placed arbitrarily in the motor space relative to the electric motor, which also permits greater freedoms for the shaping of the overall internal combustion engine.

LIST OF REFERENCE SYMBOLS

1, 1', 1" Adjustment device for electromechanical adjustment of the relative rotational angle position of a camshaft in relation to a crankshaft of an internal combustion engine
2, 2', 2" Camshaft
3, 3', 3" Adjustment mechanism
4, 4', 4" Output part of the adjustment mechanism fixed to the camshaft
5, 5', 5" Adjustment motor shaft of the electric motor
6, 6', 6" Electric motor
7, 7', 7" Adjustment shaft
8 Flexible shaft
9 Compressor
10 Pressurize reservoir
11, 11" Non-return valve
12, 12" Directional control valve
13 Pneumatic motor
14 Pump
15 Hydraulic accumulator
16 Hydraulic motor
17 Toothed gear
18 Secondary drive
19 Motor holder

The invention claimed is:

1. An adjustment device for adjusting the relative rotational angle position of a camshaft in relation to a crankshaft of an internal combustion engine, the device comprising:

an adjustment mechanism, which is provided as a triple-shaft transmission and which has an input part fixed to the crankshaft, an output part fixed to the camshaft, and an adjustment shaft connected to an adjustment motor shaft of an adjustment motor, the adjustment motor comprises an electric motor and is arranged offset and parallel to the camshaft and an adjustment torque generated by the motor is transmitted via a secondary drive to the adjustment shaft.

2. The device according to claim 1, wherein the secondary drive comprises a belt drive, a chain drive, a cardan drive, or an additional spur gear stage.

* * * * *